US009267769B1

(12) United States Patent
Gempler

(10) Patent No.: US 9,267,769 B1
(45) Date of Patent: Feb. 23, 2016

(54) HORIZONTAL STAND ASSEMBLY

(71) Applicant: Gregory Allan Gempler, Boise, ID (US)

(72) Inventor: Gregory Allan Gempler, Boise, ID (US)

( * ) Notice: Subject to any disclaimer, the term of this patent is extended or adjusted under 35 U.S.C. 154(b) by 156 days.

(21) Appl. No.: 13/867,652

(22) Filed: Apr. 22, 2013

Related U.S. Application Data

(60) Provisional application No. 61/673,060, filed on Jul. 18, 2012.

(51) Int. Cl.
*F41J 1/10* (2006.01)
*B25H 1/06* (2006.01)

(52) U.S. Cl.
CPC ..... *F41J 1/10* (2013.01); *B25H 1/06* (2013.01)

(58) Field of Classification Search
CPC ..... F41J 1/00; F41J 1/10; B25H 1/06; E04G 1/32
USPC ..... 273/403–410, 390–392; 472/118, 125; 248/121, 164; 182/224–227
See application file for complete search history.

(56) References Cited

U.S. PATENT DOCUMENTS

| | | | | |
|---|---|---|---|---|
| 1,597,555 | A * | 8/1926 | Tolmie | 182/224 |
| 2,899,204 | A * | 8/1959 | Ratay | 273/392 |
| 3,175,642 | A * | 3/1965 | Neeley | 182/224 |
| 4,268,087 | A * | 5/1981 | Sorrentino | 297/273 |
| 4,457,399 | A * | 7/1984 | Breisch | 182/185.1 |
| 4,903,796 | A * | 2/1990 | Magyar et al. | 182/129 |
| 5,484,037 | A * | 1/1996 | Neumarkel | 182/185.1 |
| 6,761,249 | B2 * | 7/2004 | Garcia | 182/153 |
| 8,079,915 | B2 * | 12/2011 | Spencer et al. | 472/118 |
| 8,720,896 | B2 * | 5/2014 | Matthis | 273/407 |
| 8,844,934 | B2 * | 9/2014 | Dean et al. | 273/407 |

* cited by examiner

*Primary Examiner* — Mark Graham
(74) *Attorney, Agent, or Firm* — Jeffrey Parry Intellectual Property Law Group PLLC; Jeffrey C. Parry

(57) ABSTRACT

A horizontal stand assembly enables a user to mount a target for shooting which can be easily repaired, relocated or stored. The horizontal stand assembly includes a first bracket connected to a second bracket where each bracket has an offset trapezoidal shape with a front angled cavity which angles backward and is offset from a rear angled cavity which angles frontward such that each bracket can accommodate a front post in the front angled cavity and a rear post in the rear angled cavity. Each bracket further comprises a horizontal cavity such that horizontal posts can be placed through each horizontal cavity connecting the first bracket to the second bracket such that the target can be hung from the horizontal posts without deflecting.

6 Claims, 3 Drawing Sheets

HORIZONTAL STAND ASSEMBLY

CROSS REFERENCE TO RELATED APPLICATIONS

This application claims priority to U.S. Provisional Patent Application 61/673,060 filed on Jul. 18, 2012.

FIELD OF THE INVENTION

This invention relates to devices that can mount horizontal surfaces.

BACKGROUND OF THE INVENTION

Prior to the disclosed invention, target stands were home-made, cumbersome, non-adjustable, heavy, unstable and not durable. Usually a damaged component of a prior art target stand results in the failure of the whole product. Further, prior art target stands cannot be easily repaired, relocated or stored due to their designs, construction and weight. Embodiments of the present invention solve these problems.

BRIEF SUMMARY OF THE INVENTION

A horizontal stand assembly enables a user to mount a target for shooting which can be easily repaired, relocated or stored. The horizontal stand assembly includes a first bracket connected to a second bracket where each bracket has an offset trapezoidal shape with a front angled cavity which angles backward and is offset from a rear angled cavity which angles frontward such that each bracket can accommodate a front post in the front angled cavity and a rear post in the rear angled cavity. Each bracket further comprises a horizontal cavity such that horizontal posts can be placed through each horizontal cavity connecting the first bracket to the second bracket such that the target can be hung from the horizontal posts without deflecting.

BRIEF DESCRIPTION OF THE SEVERAL VIEWS OF THE DRAWINGS

Figure 1:
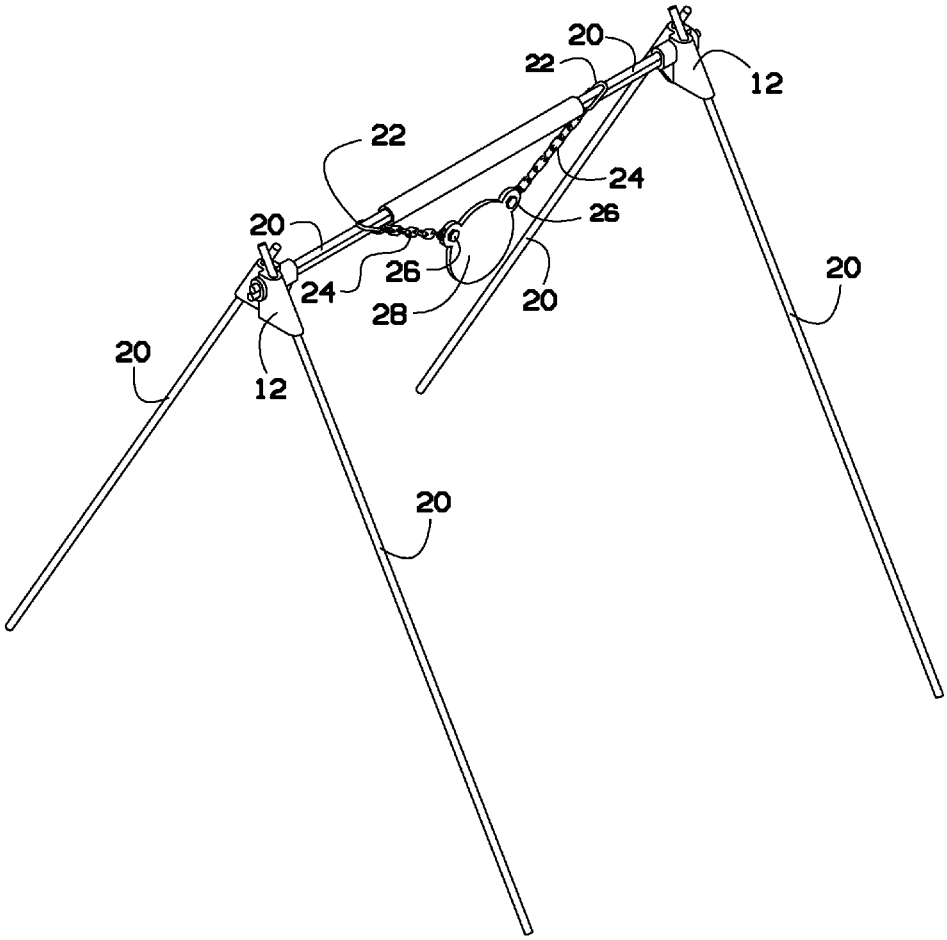

Having thus described the invention in general terms, reference will now be made to the accompanying drawings, which are not necessarily drawn to scale, and wherein:

FIG. 1 is a perspective view of an embodiment of the invention shown in use.

Figure 2:
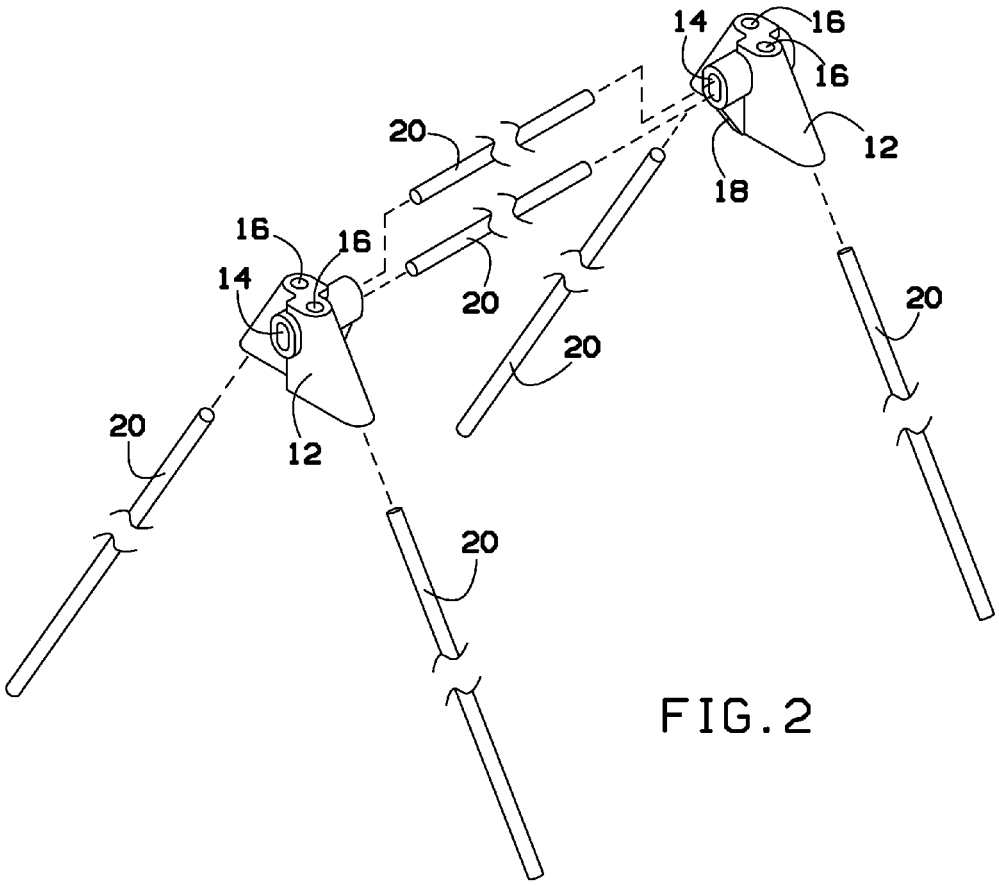

FIG. 2 is an exploded view of an embodiment of the invention.

Figure 3:
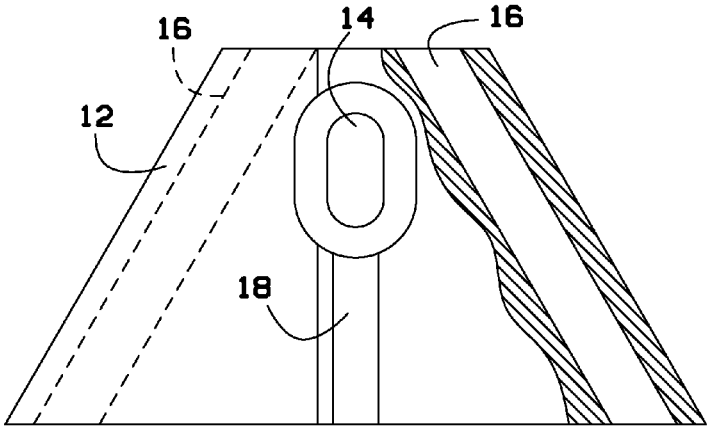

FIG. 3 is a front view of an embodiment of the invention.

Figure 4:
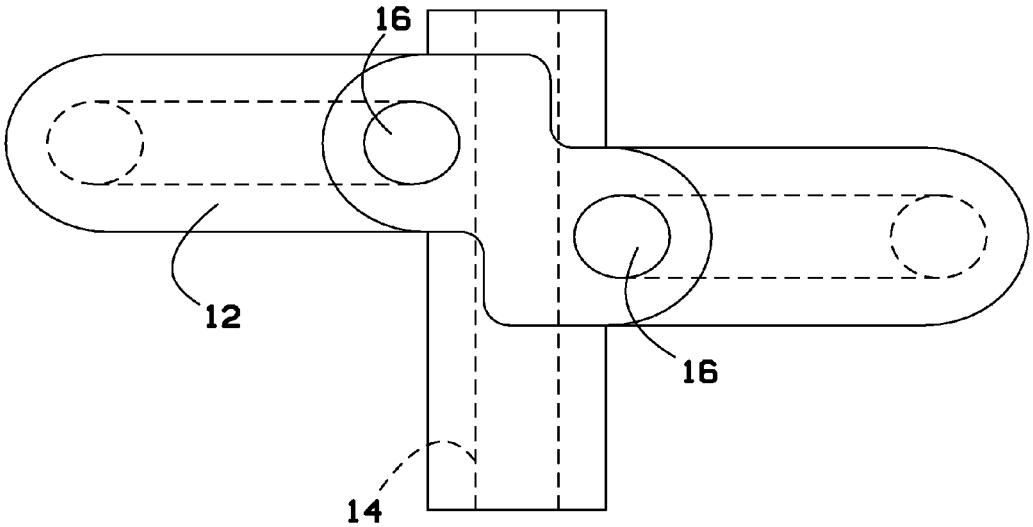

FIG. 4 is a top view of an embodiment of the invention.

Figure 5:
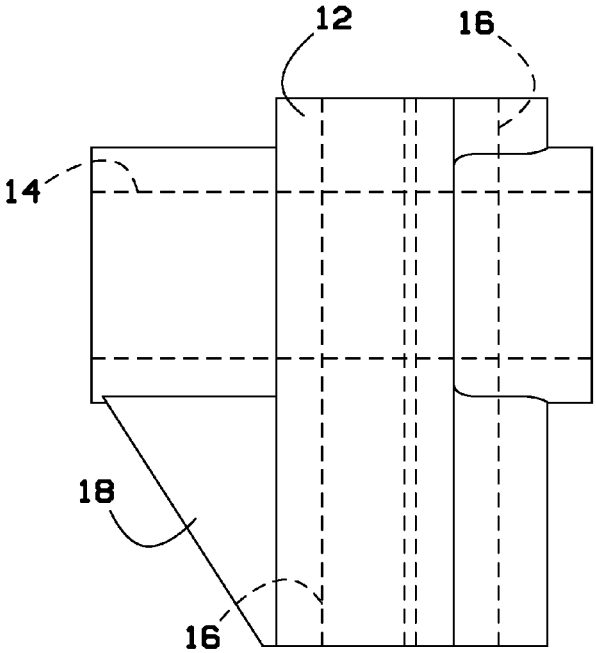

FIG. 5 is a side view of an embodiment of the invention.

DETAILED DESCRIPTION OF THE INVENTION

Embodiments of the present invention overcome many of the obstacles associated with hanging a target at which to shoot, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows an embodiment of the horizontal stand assembly in use. The horizontal stand assembly comprises a first bracket 12 which is immediately adjacent to a first front post 20, a first rear post 20, a first horizontal post 20 and a second horizontal post 20.

The first horizontal post 20 and the second horizontal post 20 are immediately adjacent to a second bracket 12. The second bracket 12 is immediately adjacent to a second front post 20 and a second rear post 20.

The horizontal stand assembly can support target 28 by having a user mechanically couple target 28 to right chain 24 with right bolt 26. Right chain 24 is mechanically coupled to right carabiner 22 which can be placed over first horizontal post 20 and the second horizontal post 20. Likewise, target 28 is further mechanically coupled to left chain 24 with left bolt 26. Left chain 24 is mechanically coupled to left carabiner 22 which can be placed over first horizontal post 20 and the second horizontal post 20.

The construction has many advantages, for instance, first horizontal post 20 and second horizontal post 20 do not need to be level to ground, rather gravity will have target 28 hang perpendicular to ground. This effect can be increased by ensuring that the coefficient of static friction between each carabiner 22 and horizontal posts 20 is sufficient that either carabiner 22 does not slide down horizontal posts 20. In some embodiments, this can be accomplished by placing a high friction surface over first horizontal post 20 and second horizontal post 20. Nonetheless, bracket 12 possesses many features which ensure that first horizontal post 20 and second horizontal post 20 are nearly parallel to ground.

FIG. 2, FIG. 3, FIG. 4 and FIG. 5 show bracket 12 in more detail. Bracket 12 has an offset trapezoidal shape with a front angled cavity 16 which angles backward and is offset from a rear angled cavity 16 which angles frontward. Two legs may be inserted by sliding a post 20 into each bracket 12 and then spreading the posts 20 from each other to the desired angle to provide the triangular leg arrangement and engage the friction lock bump within cavity 16. In one embodiment, front angled cavity 16 and rear angled cavity 16 each form a friction fit with front post 20 and rear post 20, respectively. In one embodiment, horizontal cavity 14 forms a friction fit with horizontal posts 20. Bracket 12 further comprises horizontal cavity 14. Bracket 12 can be additionally reinforced with gusset 18. As used in this application "each bracket" refers to both first bracket 12 and second bracket 12. This configuration offers several advantages, a few of which are enumerated below.

FIG. 2 and FIG. 3 show how first horizontal post 20 and second horizontal post 20 can fit between first bracket 12 and second bracket 12. In some embodiments, target 28 can be made of metal, is heavy and could potentially deflect a single horizontal post 20. That problem is solved by arranging a pair of horizontal posts in such that first horizontal post 20 and second horizontal post 20 fit snugly inside horizontal cavity 14, but still can slide in and out of horizontal cavity 14. Traditional engineering would eschew this design since the tightness of first horizontal post 20 and second horizontal post 20 inside horizontal cavity 14 would render the system statically indeterminable and loading conditions would not be readily discerned.

The loading conditions include the normal force on right carabiner 22 and left carabiner 22 called $N_C$ and can also include dynamic and vibration forces that can occur as a result of shooting a bullet at target 28 which can be modeled as force normal target 28 called $N_T$. In particular, the dynamic vibration component of $N_T$ can be mitigated with the following design features: first, the use of right chain 24 and left chain 24 allow for the weight of target 28 to absorb a substantial amount of vibration. Second, a user can use rebar for all posts 20 which is particularly resilient to both static and dynamic force. Third, by snugly placing first horizontal post 20 and second horizontal post 20 inside horizontal cavity 14, without actually affixing first horizontal post 20 and second horizontal post 20 inside horizontal cavity 14.

Nonetheless, there will still be a component of $N_T$ in both the normal and orthogonal directions that cannot be mitigated and will be applied to first front post 20, first rear post 20, second front post 20 and second rear post 20. The present invention handles this force in the following ways: First, the offset trapezoidal shape of bracket 12 prevents a front post 20 from contacting a rear post 20 and thus avoids a vibration multiplier effect of having the two poles directly contact each other. To the extent traditional camping tents may be similar, direct pole contact in those designs teaches away from the present invention. Second, at different points of movement of target 28, the front posts 20 or the rear posts 20 could have a higher load. The present invention resolves this by having an bracket 14 take the shape of a regular trapezoid (offset as noted above) where front angled cavity 16 is parallel to a first side and rear angled cavity 16 is parallel to a second side, this assures relatively uniform loading as target 28 moves back and forth.

By having posts 20 immediately adjacent to, but not mechanically coupled to brackets 12, the horizontal stand assembly can be easily repaired, relocated or stored.

That which is claimed:

1. A horizontal target stand assembly comprising:

a first bracket and a second bracket, where each of the first bracket and the second bracket has an offset trapezoidal shape with a front angled cavity which angles backward and is offset from a rear angled cavity which angles frontward such that each bracket can accommodate a front post in the front angled cavity and a rear post in the rear angled cavity; each of the first bracket and the second bracket further comprising an oblong horizontal cavity such that two parallel adjacent horizontal posts can be placed through each horizontal cavity connecting the first bracket to the second bracket; and two parallel adjacent horizontal posts passing through the oblong horizontal cavity of the first bracket and the oblong horizontal cavity of the second bracket.

2. The horizontal stand assembly of claim 1, wherein:

a target is mechanically coupled to a right chain which is further affixed to the horizontal posts with a right carabiner; and the target is further mechanically coupled to left chain which is further affixed to the horizontal posts with a left carabiner to reduce a vibration component of a normal force created on the target when struck with a bullet.

3. The horizontal stand assembly of claim 2, wherein:

each front angled cavity is parallel to a first side on each bracket and each rear angled cavity is parallel to a second side on each bracket to assure relatively uniform loading as the target moves when struck with a bullet.

4. The horizontal stand assembly of claim 1, further comprising a target hanging from the two parallel adjacent horizontal posts.

5. The horizontal stand assembly of claim 1, wherein:

the front angled cavity forms a friction fit with the front post;

the rear angled cavity forms a friction fit with the rear post; and the horizontal cavity forms a friction fit with the horizontal posts.

6. A method of assembling a target stand, comprising:

inserting a front post into a front cavity of a first target stand bracket;

inserting a rear post into a rear cavity of the first target stand bracket, wherein the first target stand bracket has an offset trapezoidal shape with the front cavity having a backward angle and the rear cavity having a frontward angle;

adjusting a height of the front post by longitudinally sliding the front post within the front cavity;

adjusting a height of the rear post by longitudinally sliding the rear post within the rear cavity;

locking the front post into the first target stand bracket by forming a friction fit with the front post in the front cavity;

locking the rear post into the first target stand bracket by forming a friction fit with the rear post in the rear cavity;

inserting two parallel adjacent horizontal posts into an oblong horizontal cavity of the first target stand bracket; and connecting the first target stand bracket to a second target stand bracket by the two horizontal posts, the second target stand bracket having a substantially similar structure as the first target stand bracket.

* * * * *